United States Patent [19]

Del Fabbro

[11] 3,991,737

[45] Nov. 16, 1976

[54] FORCED-CONVECTION OVEN

[75] Inventor: Claudio Del Fabbro, Porcia, Pordenone, Italy

[73] Assignee: Zanussi Grandi Impianti S.p.A., Pordenone, Italy

[22] Filed: Apr. 30, 1975

[21] Appl. No.: 573,256

[30] Foreign Application Priority Data

May 18, 1974 Italy ..... 45729/74

[52] U.S. Cl. ..... 126/21 A

[51] Int. Cl.[2] ..... F24C 15/32

[58] Field of Search ..... 126/21 R, 21 A, 273

[56] References Cited

UNITED STATES PATENTS

| | | | |
|---|---|---|---|
| 3,063,441 | 11/1962 | Stoligrosz | 126/21 A |
| 3,384,068 | 5/1968 | Perry et al. | 126/21 A |
| 3,605,717 | 9/1971 | Sauer | 126/21 A |
| 3,710,775 | 1/1973 | Tamada et al. | 126/21 A |

*Primary Examiner*—Edward G. Favors

*Attorney, Agent, or Firm*—Holman & Stern

[57] ABSTRACT

A convection oven is disclosed in which a duct for drawing hot air from the combustion chamber conveys the hot air to the heating chamber, said duct extending through the ventilation chamber and communicates therewith; it also communicates with an outlet duct so as to convey all the air drawn from the combustion chamber and a fractional volume of the ventilated air towards the outlet duct. The advantages are a reduction of the temperature of the fluids and a finer adjustment of the temperature in the useful areas of the oven.

7 Claims, 7 Drawing Figures

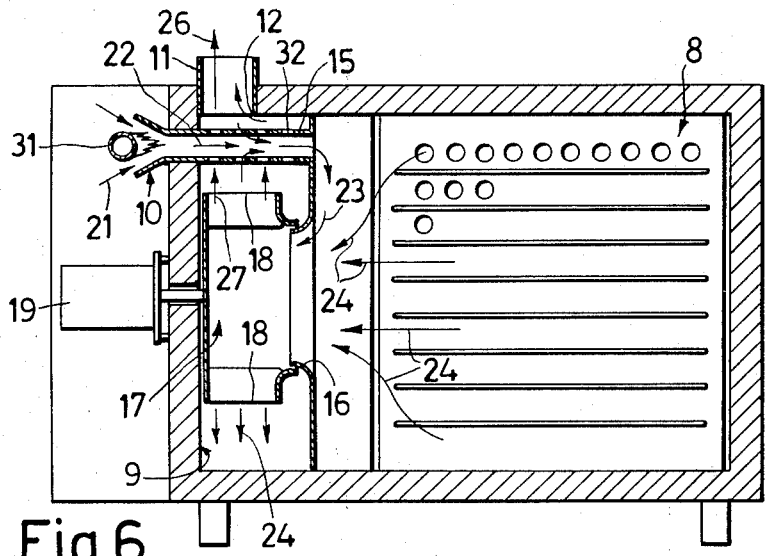
Fig.6
Fig.7
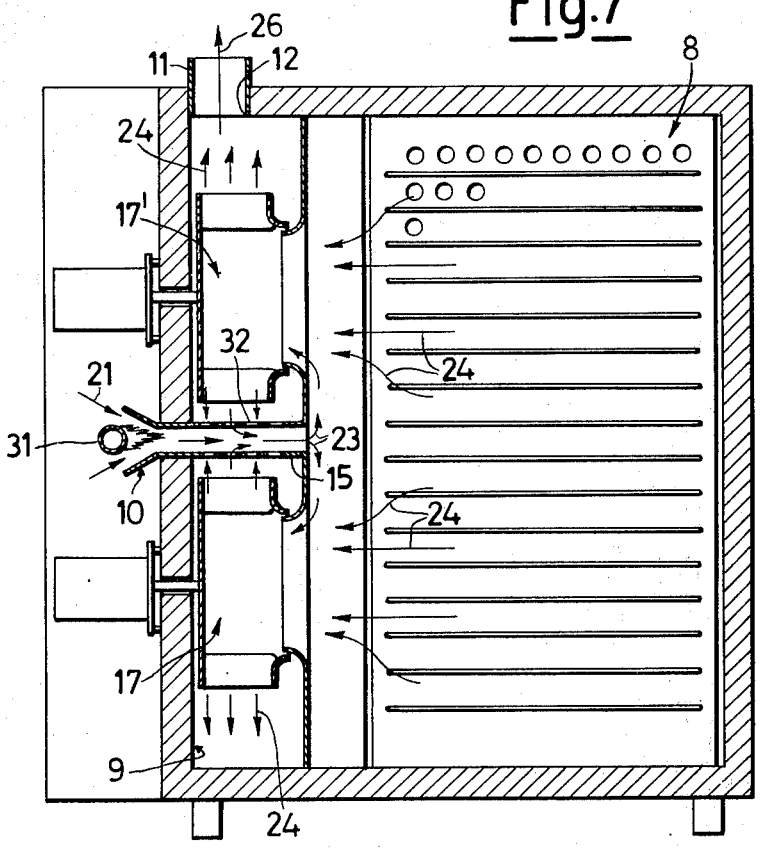

FORCED-CONVECTION OVEN

FIELD OF THE INVENTION

This invention relates to a convection oven of the kind in which hot air is forced by a blower so as to flow into a heating chamber in such a way as to impinge on the food to be either cooked or reheated. More particularly, the invention relates to a direct heating convection oven, that is, one of the kind in which there is the direct feed of exhaust gases into the heating chamber.

BACKGROUND OF THE INVENTION

A few forced-convection ovens are known of the kind referred to above, which are affected by considerable common functional problems, among which the superheating of the intake ducts for the exhaust gases and the defective accessibility to the several component parts, especially the burner(s). Usually, in point of fact, in these ovens the exhaust gases attain very high temperatures, in the order of 700°–900° C, so that it becomes necessary (in order to reduce superheating) to employ special materials (thus costly ones) having quite special properties of heating resistance, or to resort to appropriate (but intricate) expedients adapted to allow the cooling of the walls of these ducts. In a few cases, in additon, both the combustion chamber and the burners are housed in the vicinity of the bottom wall of the oven, or, at any rate, at a level which is below that of the blower, so that also other component parts of the oven (such as the blower motor and the control devices) are apparently subjected to undesirably high temperatures which detract from the functional reliability of the oven. More particularly, a forced-convection oven is known in which the combustion chamber is arranged immediately beneath the blower, the latter being protected from superheating by the insertion of a gilled plate cooled by the blower as such. This approach is by no means satisfactory, in that after a long period of operation the dirt particles deposited on the plate gills decrease its heat-dissipating capacity and involve serious cleaning difficulties for the plate, the latter being not easily accessible.

SUMMARY AND OBJECTS OF THE INVENTION

An object of the present invention is to provide an oven of the kind referred to above in which the above enumerated defects are done away with in a simple and cheap way, while retaining a high degree of reliability and functional efficiency of the oven.

Another object of the invention is to provide a forced-convection oven the component parts of which, more particularly the burner in the combustion chamber, are readily accessible.

An additional object is to provide an oven of the kind referred to above having an improved system for circulating air between the combustion chamber, the heating chamber and the outlet, so as to ensure an optimun thermal condition of operation while avoiding the adoption of special materials, all this by abiding by the standard specifications.

These objects are achieved, according to the invention, in a direct heating forced convection oven having substantially arranged side by side and communicating in the conventional way, a heating chamber, a ventilation chamber with at least one blower the inlet mouth of which communicates with the heating chamber, and a combustion chamber through which ambient air is drawn in by the blower and heated, characterized in that it comprises a duct for drawing in hot air from the combustion chamber towards said heating chamber. The duct is extended through the ventilation chamber and communicated therewith as well as with an outlet duct, known per se, so as to convey all the hot air drawn from the combustion chamber and a fraction of the ventilated air directed towards said outlet duct.

The features and the advantages of the invention will become more clearly apparent from the ensuing description, given by way of example only and without limitation, reference being had to the accompanying drawings, wherein:

DESCRIPTION OF PREFERRED EMBODIMENTS

Figure 1:
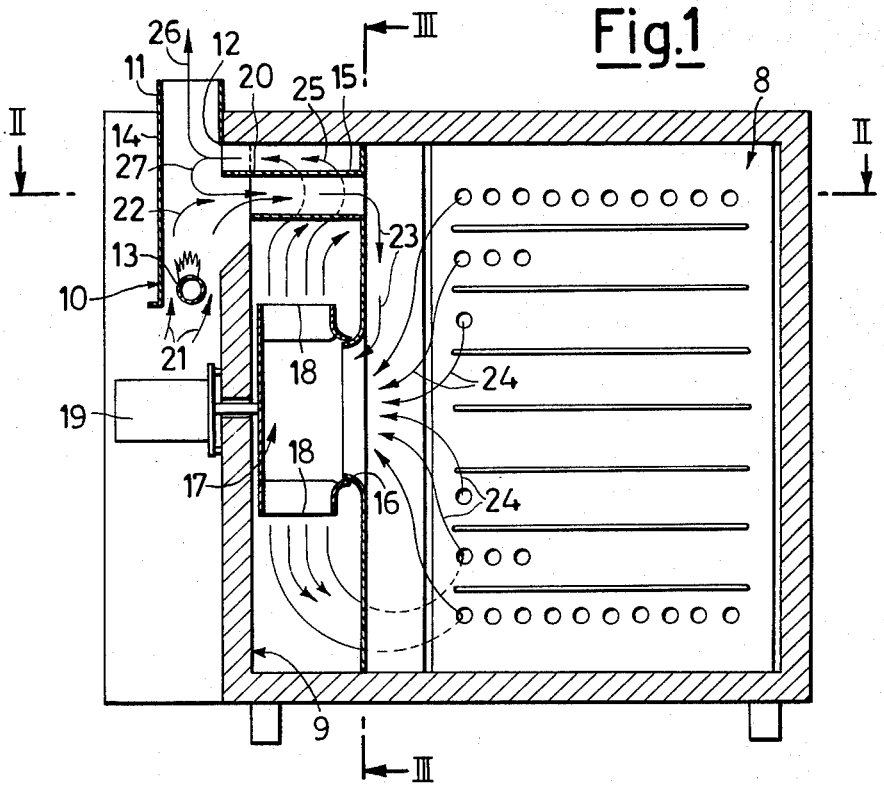
FIG. 1 is a diagrammatical showing of a front cross-sectional view of a preferred embodiment of a convection oven according to this invention.
Figure 2:
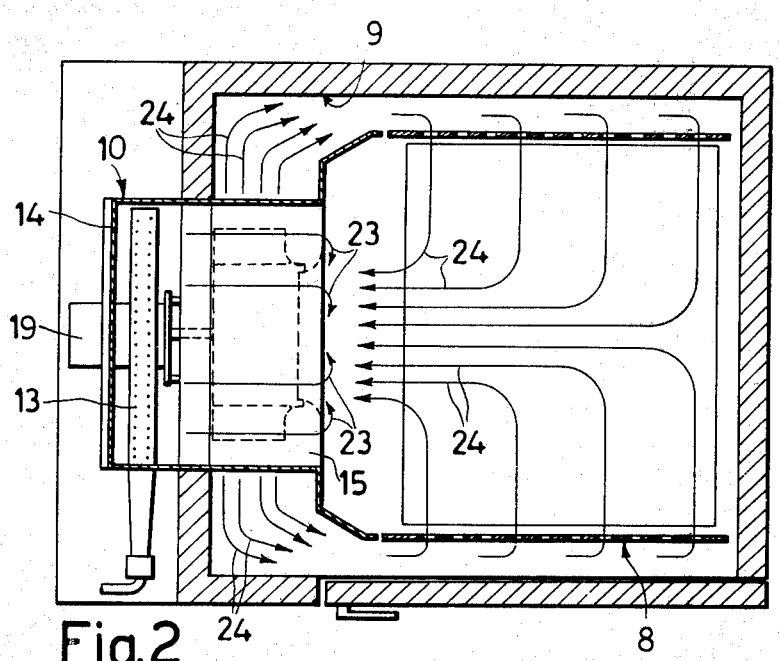
FIG. 2 diagrammatically shows a cross-sectional view taken along the line II—II of the oven shown in FIG. 1.
Figure 3:
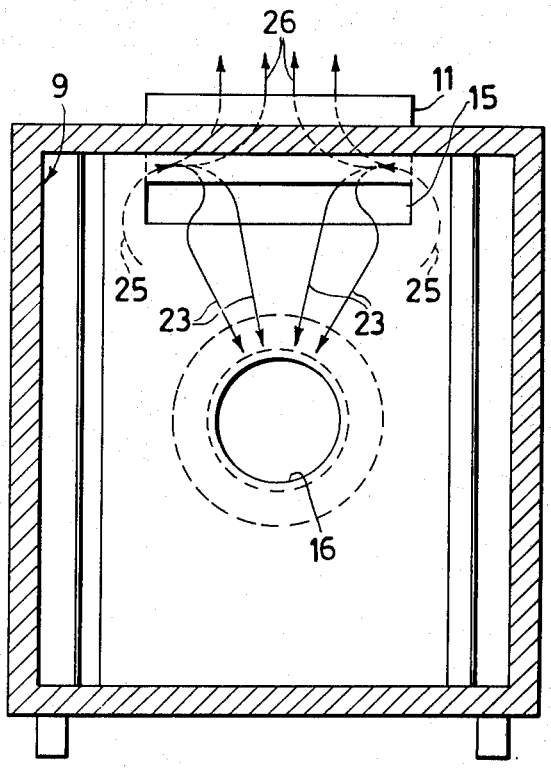
FIG. 3 diagrammatically shows a cross-sectional view taken along the line III—III of FIG. 1.

Having now particular reference to FIGS. 1, 2 and 3, the convection oven according to this invention comprises, in substantially side-by-side relationship and communicating with one another in the conventional manner, a heating chamber 8 for the food to be cooked, a ventilation chamber 9 and a combustion chamber 10. The latter is housed adjacently to the oven top and directly communicates with an outlet duct 11, the discharge mouth of which, 12, is located in correspondence with the oven top. At least a burner 13 of the atmospherical type, preferably a linear one, is arranged on the (open) bottom wall of the combustion chamber 10 and is positioned on the vertical of the mouth 12 of the outlet conduit 11. As shown in FIG. 1, the latter conduit is partially constituted by an upwardly directed extension of a substantially planar and vertical wall 14 of the combustion chamber. An induction duct 15, preferably of boxlike outline, is extended from the combustion chamber 10 and, by passing through the ventilation chamber 9, is terminated in the heating chamber 8, in the vicinity of the inlet mouth 16 of at least one blower 17. The blower 17 is arranged in the ventilation chamber 9 and the mouth 16 directly communicates with the heating chamber 8. The blower 17 is of the centrifugal type with an outlet section 18 and is actuated by a motor 19, which is coaxial and arranged beneath the combustion chamber 10. In the inside of the latter chamber, a top wall 20 of the conduit 15 is extended along a certain length, substantially perpendicularly to the planar wall 14, at a level slightly below that of the outlet mouth 12 and above the level of the burner 13. Thus, in correspondence with the extension 20, the intake duct 15 communicates with both the ventilation chamber and the discharge duct 11.

The arrows shown in the drawings indicate the air streams which flow during the operation in the interior of the oven according to the invention.

When the blower 17 is in action, ambient air 21 is drawn through the combustion chamber 10 (wherein it is heated by the flame of the burner 13, arrows 22) and conveyed by the duct 15 to flow with a stream 23 towards the intake mouth 16 of the blower 17. Through the outlet section 18, the blower causes thus air (which becomes gradually cooled during its flow) to circulate in forced manner, partly (arrows 24) through the heating chamber 8, and partly towards the outlet mouth 12, with a stream 25 which exists at a level comprised between the intake duct 15 and the top of the ventilation chamber 9. The airstream 24 (which, as will become clearer hereinafter, has a temperature of about 250° C) yields heat to the food housed in the chamber 8 (giving rise to the desired cooking or heating thereof) and is then drawn into the mouth 16 of the blower, wherefrom it is recirculated together with the airstream 23. Concurrently, due to the combined action of the vertical wall 14 and the extension 20 of the intake duct, the airstream 25 is deflected (substantially to the same extent), partly to the discharge 11 (arrow 26) and partly (arrow 27) again to the intake duct 15. This partial flow 27 of air deflected and drawn in again along the duct 15 is at a temperature of about 250° C and fulfils a twofold important task: it is admixed with the flow 22 of heated air (at about 700°–900° C) from the burner 13, thus lowering the temperature of the combined flow 23 (to about 500° C). Thus the above outlined superheating problems are minimized, while maintaining the air 24 flowing through the heating chamber 8 at an optimum temperature for cooking the food and without impairing the thermal efficiency of the oven. It is extended above the flame of the atmospherical burner 13 so as to provide an air pad adapted to prevent the exhaust gases 22 from being directly sent to the outlet 11, but, conversely, they are conveyed to the intake duct 15.

To achieve the ideal conditions as outlined above, the several component parts of the oven should be designed, as it is apparent, in an appropriate manner (for example the volumes of air of the flowing streams should be calculated so as to be combined together in such ratios as to permit the obtention of the desired temperature values, preferably those indicated above), as it appears obvious for those skilled in the art.

Inasmuch as the burner 13 is of the atmospherical type, it is not genatively influenced by the accidental stoppage of the blower 17. If this happens, the exhaust gases as generated by the burner 13, which are no longer hindered by the above indicated air pad 27, can be directed (without any damage for the oven) directly to the outlet duct 11. In the latter there can be housed a conventional thermostatic device (not shown) adapted to detect the consequential temperature increase, by cutting off (in a conventional way, not shown) the feed of fuel to the atmospherical burner 13 and possibly actuating a signalling device (also conventional and not shown). In any case, the reliability in operation of the oven in question is apparent and the objects of the invention are achieved thereby while abiding by the specifications.

Figure 5:
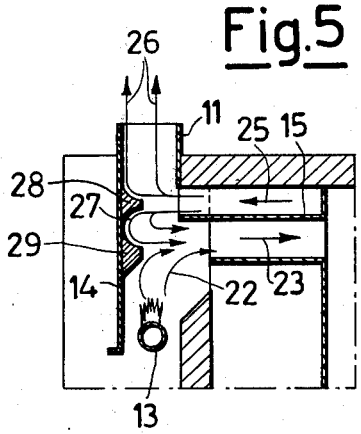
FIGS. 4 and 5 diagrammatically show the respective details of the oven of FIG. 1; according to different embodiments, and FIGS. 6 and 7 diagrammatically show a front cross-sectional view of the respective alternative embodiments of the oven of FIG. 1.
Figure 4:
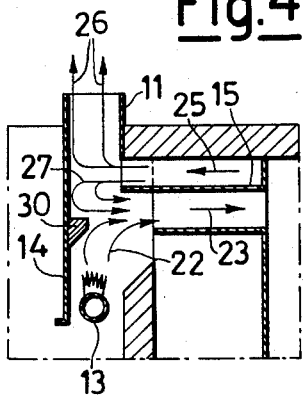

With reference to FIGS. 4 and 5, in order to obtain a better sharing of the airstream 25 in the two parts 26 and 27, the vertical wall 14 of the combustion chamber 10 can be shaped with one or more specially provided projections 30 (FIG. 4), or 28, 29 (FIG. 5) which do not substantially change the operation of the oven as described above.

FIG. 6 shows a convection oven according to the invention, which employs a burner 31 of the ventilated type (the hygienically acceptable combustion of which is warranted only when the blower is in action). Such an oven differs from the one described above in that the portion of the intake duct 15 which is extended through the ventilation chamber 9 is equipped with at least one opening 32 and the mouth 12 of the outlet 11 is arranged at the top of the ventilation chamber 9. Apart from the different kind of burner used, the operation of the oven according to the embodiment of FIG. 6 is substantially identical to that of the already described oven. Also in this case, in fact, a limited amount of the air emerging from the section 18 of the blower 17 is directed towards the outlet 11, partly by directly entering it (arrows 26) and partly by seeping through the openings 32 in the duct 15 (arrows 27). Thus, as in the previous case, the flow 27 causes, by admixture, the partial cooling of the air 22 heated by the burner 31, bringing the resultant airstream 23 to a temperature (about 500° C) at which no special superheating problems may occur. Simultaneously, the predominant fraction of the air forced by the blower 17 is circulated as a flow 24 through the heating chamber 8, impinging on the food to be either cooked or heated.

In both the approaches as described above, the oven according to the invention affords a number of advantages, among which the following can enumerated:

a. "Thermal dilution" of the exhaust gases, the result being a reduction of the temperature in correspondence with the intake duct 15. With an equal functional reliability, there can thus be employed, for the manufacture of the critical component parts of the oven, less noble materials (cheaper) an a better distribution of the temperature within the oven can be achieved.

b. Minimizing the heating of the motor 19, due to the top position of the combustion chamber 10 and its burner.

c. Easy accessibility (due to their assembly position) of the several component parts, especially the burner.

d. Reduction of the overall bulk, due to the superposed position of the burner and the electric motor 19, which can be compared to those (regarded as a minimum) of a corresponding electric oven.

e. as a result of what has been said in the previous paragraphs the construction and cleaning of the ducts for the exhaust gases is simplified.

Virtually all of these advantages can be found even if only partially as regards the one listed under (b) (above) also in the embodiment of FIG. 7, wherein the oven is similar to that described in FIG. 6, but the vertical dimensions are larger. As a single change, the oven has two superposed blowers 17 and 17' between which the foraminous intake duct 15 is extended. Also the operation, which can easily be understood, is substantially identical to that of the oven of FIG. 6, except that the air emerging from the duct 15 is shared into two discrete steam paths, each of which is determined by the relative blower. In addition, the exhaust gases inside the duct 15 are partially cooled by the action of both blowers 17 and 17'.

Obviously, many other modifications can be introduced in the oven in question. For example, the ducts which convey the flowing air can be variously sized and oriented, and they can be made of different materials as well, according to the requirements and without departing from the scope of the invention.

What is claimed is:

1. A direct heating forced convection oven comprising a heating chamber, a ventilation chamber laterally adjacent and communicating with the heating chamber, a combustion chamber laterally adjacent the ventilation chamber, at least one burner housed in the combustion chamber to provide hot air, at least one outlet duct communicating with the ventilation chamber, at least one blower housed in the ventilation chamber with an intake mouth communicating with the heating chamber and at least one discharge mouth arranged in such a manner as to direct ventilated air partly to the heating chamber and partly to the outlet duct and an intake duct passing through the ventilation chamber to draw hot air from the combustion chamber to the heating chamber, said intake duct communicating with the ventilation chamber and being arranged in such a manner as to receive a fraction of the ventilated air discharged by the blower and to convey it to the heating chamber together with the hot air drawn from the combustion chamber.

2. A convection oven according to claim 1, wherein said outlet duct is arranged on the top of the oven, characterized in that said combustion chamber is housed adjacent of said oven top, said intake duct communicating with the ventilaton chamber in the vicinity of said outlet duct.

3. A convection oven according to claim 2, wherein at least one burner of the atmospherical type is housed on the bottom of said combustion chamber, characterized in that said burner is positioned on the vertical of the inlet mouth of the outlet duct, said combustion chamber being equipped with baffle means adapted partially to deflect said ventilated air towards said mouth, so as to produce a stream directed towards said intake duct and forming an air pad for the exhaust gases of the flame of said burner.

4. A convection oven according to claim 3, characterized in that said baffle means comprise a planar wall which is substantially vertical and towards which said intake duct is extended substantially in a perpendicular direction and at least partially in the interior of the combustion chamber, at a level which is below that of the discharge mouth and above the level of said burner.

5. A convection oven according to claim 3, characterized in that said baffle means comprise a wall which is substantially perpendicular and opposed to the intake duct, shaped so as partially to deflect towards the latter duct said ventilated air directed towards the discharge duct.

6. A convection oven according to claim 1, wherein at least a burner of the ventilated type is housed in the combustion chamber, characterized in that the portion of the intake duct extending through the ventilation chamber is equipped with at least one opening for connecting the duct with the ventilation chamber.

7. A convection oven according to claim 1, wherein at least two blowers are arranged in the ventilation chamber at different levels and at least one burner of the ventilated type is housed in the combustion chamber, characterized in that the intake duct is extended through the ventilation chamber as substantially inserted between the two blowers and is equipped with at least one opening for connecting it with the ventilation chamber.

* * * * *